US005609140A

United States Patent [19]

Kramer et al.

[11] Patent Number: 5,609,140

[45] Date of Patent: Mar. 11, 1997

[54] FUEL SUPPLY SYSTEM FOR AN INTERNAL COMBUSTION ENGINE

[75] Inventors: Claus Kramer, Besigheim; Armin-Maria Verhagen, Stuttgart; Dietrich Trachte; Gerhard Keuper, both of Leonberg, all of Germany

[73] Assignee: Robert Bosch GmbH, Stuttgart, Germany

[21] Appl. No.: 550,491

[22] Filed: Oct. 30, 1995

[30] Foreign Application Priority Data

Dec. 23, 1994 [DE] Germany ..... 44 46 277.8

[51] Int. Cl.[6] ..... F02M 37/04; F02M 41/00

[52] U.S. Cl. ..... 123/497; 123/458

[58] Field of Search ..... 123/497, 478, 123/179.17

[56] References Cited

U.S. PATENT DOCUMENTS

| | | | |
|---|---|---|---|
| 4,926,829 | 5/1990 | Tuckey | 123/497 |
| 4,940,034 | 7/1990 | Heim et al. | 123/497 |
| 5,085,193 | 2/1992 | Morikawa | 123/497 |
| 5,218,941 | 6/1993 | Suzuki et al. | 123/478 |
| 5,237,975 | 8/1993 | Betki et al. | 123/497 |
| 5,355,859 | 10/1994 | Weber | 123/497 |
| 5,379,741 | 1/1995 | Matysiewicz et al. | 123/497 |
| 5,406,922 | 4/1995 | Tuckey | 123/497 |
| 5,411,002 | 5/1995 | Smitley | 123/497 |
| 5,477,833 | 12/1995 | Leighton | 123/497 |
| 5,479,910 | 1/1996 | Bauer et al. | 123/497 |
| 5,483,940 | 1/1996 | Namba et al. | 123/497 |
| 5,501,196 | 3/1996 | Brunnhofer | 123/497 |

FOREIGN PATENT DOCUMENTS 2808731 9/1979 Germany .

*Primary Examiner*—Thomas N. Moulis
*Attorney, Agent, or Firm*—Kenyon & Kenyon

[57] ABSTRACT

In a fuel supply system for an internal combustion engine, significant parameters such as fuel pressure and fuel flow rate are determined continuously from measured variables with the aid of an observer. These variables which have been determined are used to achieve fuel delivery performed with regard to a requirement, the control operations being carried out as a function of requirements of the internal combustion engine by the control unit itself.

9 Claims, 5 Drawing Sheets

FUEL SUPPLY SYSTEM FOR AN INTERNAL COMBUSTION ENGINE

BACKGROUND INFORMATION

It is known that, in fuel supply systems for internal combustion engines, the fuel is pumped out of the fuel tank to the injection valves with the aid of an electric fuel pump, the excess fuel being returned to the fuel tank via a return line.

Since a greater or smaller quantity of fuel is required in the case of different loading of the internal combustion engine, the fuel supply is regulated by the control unit of the internal combustion engine. For this purpose, the fuel pressure is, as described, for example, in German Patent Application No. 28 08 731, detected with the aid of a pressure sensor and the rotational speed and hence the delivery rate of the electric fuel pump regulated as a function of the fuel pressure measured. On the basis of the fuel pressure detected, the quantity of fuel delivered is determined, and this variable too is evaluated in the regulation of the pump.

Starting from a known fuel supply system of this kind for an internal combustion engine, an object of the present invention is to further improve the regulation of the fuel pressure and quantity of fuel delivered in the injection system by continuously observing the motor operating points.

SUMMARY OF THE INVENTION

The fuel supply system according to the present invention has the advantage that particularly exact and reliable regulation of the quantity of fuel delivered is possible without the need to measure all the variables required for regulation, in particular the fuel pressure and the fuel flow rate, themselves.

These advantages are achieved by determining the parameters of fuel pressure and fuel flow rate continuously from other variables by means of observer electronics and passing these values to the engine electronics, the engine electronics then being in a position, particularly under critical conditions such as cold starting, to compensate for a lower fuel pressure by a longer injection time.

In a particularly advantageous embodiment of the present invention, it is possible to dispense with the pressure regulator and the fuel return and to have the fuel pressure across the injection valves and the fuel flow rate regulated by the observer or the associated electronics itself. The observer can here keep the pressure constant in an advantageous manner by regulating the motor current.

If the observer observes that the pressure rises during idling or in the case of overrun cut-off for example, because little or no fuel is being injected, it can reduce the power of the pump motor by influencing the voltage applied to the pump. If the pressure then decreases, the observer assumes that fuel is being injected again. It then increases the output of the electric fuel pump. The observer in this way regulates the quantity of fuel delivered in accordance with the respective requirement.

Since the return is dispensed with in a fuel supply system of this kind, a reduction in the heating of the fuel in the tank and hence a reduction in tank emissions is advantageously achieved.

In a further advantageous configuration, a feedback loop is formed between the observer and the engine electronics. In this feedback loop, the engine electronics supply the observer with data which allow the observer to correct its pump characteristic map. In this case, the observer learns its new pump characteristic continuously and is thus in a position, in a particularly advantageous manner, to correct manufacturing tolerances and ageing phenomena of the fuel supply system.

In this configuration of the present invention, the engine electronics determine the injection time necessary to dispense the injection quantity required from the fuel pressure communicated by the observer. If the expected values, for example the lambda value where closed-loop lambda control of the engine is employed, are not achieved with an injection time interval which is reasonable for this operating point, the engine electronics assume that the fuel pressure indicated by the observer is false, for example too low. The engine electronics then communicate this discrepancy to the observer, which then corrects its pump characteristic map accordingly.

The elimination, in particular, of the high cold-starting requirements, which are no longer required in this case, provides the advantageous possibility of reducing the motor current of the fuel pump motor while maintaining the same overall volume, and hence the possibility of reducing the temperature loading of the driving electronics.

DETAILED DESCRIPTION

Figure 1:
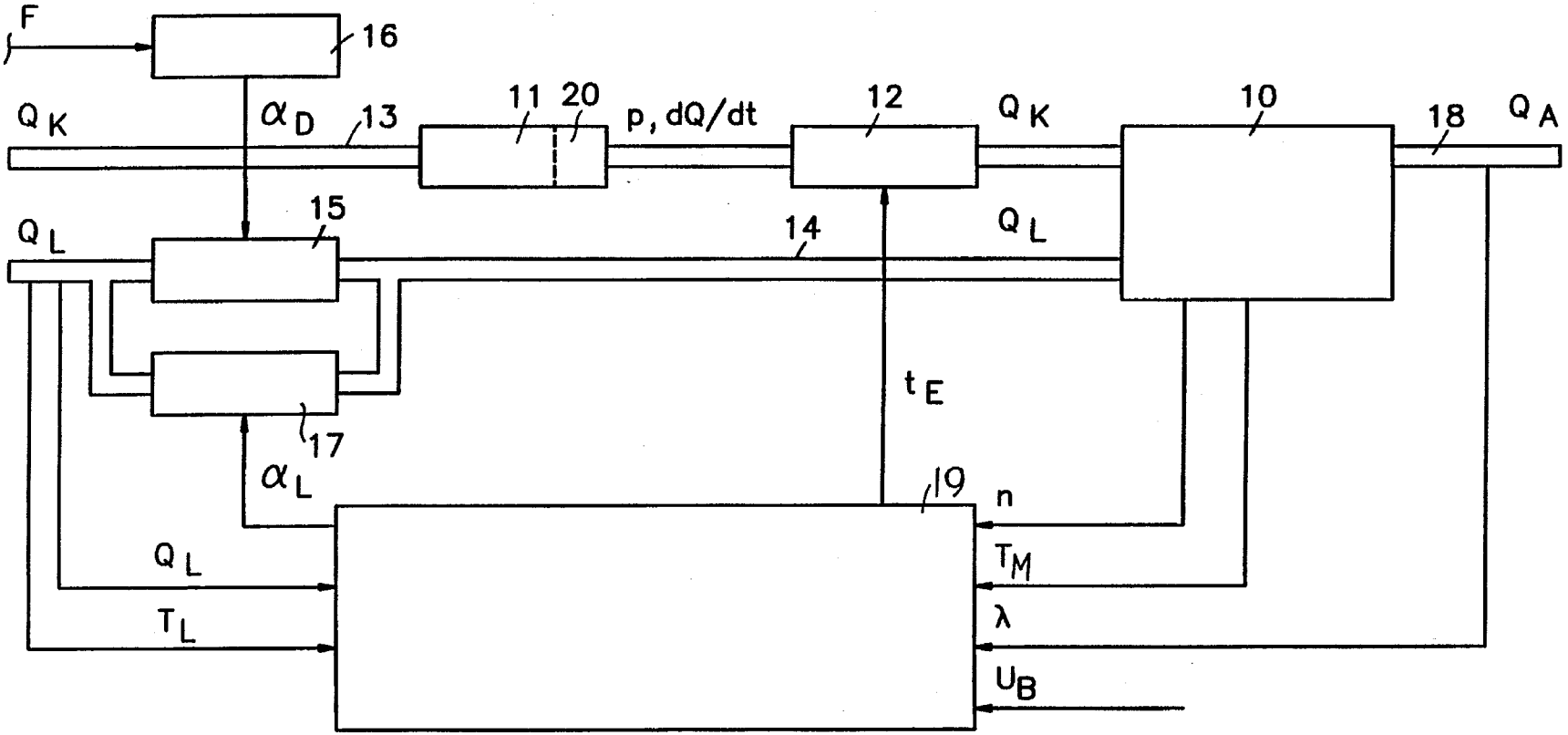
FIG. 1 shows a block diagram of a conventional system for closed-loop engine control.

FIG. 1 shows a conventional system for closed-loop engine control including the associated fuel supply system. More particularly, the internal combustion engine is denoted by 10. Of the fuel supply system, the electric fuel pump 11 and a block 12 which incorporates the injection valves are shown. 13 denotes a fuel supply line via which the electric fuel pump 11 pumps fuel from the tank (not shown) to the injection valves and hence to the internal combustion engine 10.

Via the intake pipe 14, the internal combustion engine 10 is supplied with air. In the intake pipe 14 there is a throttle valve 15, which is controlled by the driver F with the aid, for example, of an electronic accelerator pedal E-accelerator 16. An idle-speed actuator 17 is additionally arranged in the bypass of the intake pipe.

Via the exhaust line 18, the exhaust gases are carried away from the internal combustion engine 10. The entire system is controlled with the aid of the control unit 19.

The following variables which are denoted more particularly are of significance for the control of the system illustrated in FIG. 1. $Q_K$ is the quantity of fuel delivered by the electric fuel pump 11. p and dQ/dt are the fuel pressure and the change in the quantity per unit time. $Q_A$ is the quantity of exhaust gas.

$Q_L$ is the quantity of air supplied. It is controlled with the aid of the throttle valve 15, the deflection of which is denoted by the throttle-valve angle $\alpha_D$. The idle-speed actuator 17 is characterized by the variable $\alpha_L$. The quantity of fuel injected is characterized by the injection time $t_E$.

In addition to these variables, the following variables are also significant: $T_L$ is the temperature of the air drawn in. $U_B$ is the battery voltage. Lambda is the so-called lambda value and n is the speed of the engine, the temperature of which is denoted by $T_M$.

These variables are supplied to the control unit 19 or output by the latter to the corresponding assemblies as illustrated in FIG. 1. The variables are measured by associated sensors, for example.

The engine control system illustrated in FIG. 1 comprises a fuel system in which the fuel pressure and the fuel flow rate are not recorded. The fuel pressure is held constant across the injection valves 12 by means of a pressure regulator 20, which is, for example, part of the electric fuel pump 11. In this arrangement, when the pressure regulator opens, the fuel is fed back into the tank via a return (not shown in FIG. 1).

In normal operation, a continuous circulation of fuel is maintained by the electric fuel pump, fuel being pumped out of the tank and supplied to the internal combustion engine 10 via the injection valves 12. Excess fuel then returns to the tank. This circulation of fuel leads to continuous heating of the fuel in the tank and it is this which the system according to the present invention, shown in FIG. 2, is intended to avoid.

In the system illustrated in FIG. 1, the engine electronics assume that the fuel pressure p set by the pressure regulator 20 is applied to the injection valves 12. It is thus possible for the control unit 19 to determine the quantity of fuel by means of the injection time, by influencing the injection time $t_E$.

In the case of the fuel supply system illustrated in FIG. 1 with an electric fuel pump in the tank, this pump must produce the required pressure even under difficult conditions, that is to say, for example, in the case of a cold start, heavy loading of the on-board electrical system and the like. In the case of a cold start, there is thus the requirement on the fuel pump, in the case of the 6-volt operating voltage prevailing under unfavorable conditions, for a very high pump output to ensure that the operating pressure is reached. Tests have shown that a flow rate dQ/dt of 20 liters per hour is necessary to produce a pressure of 430 kPA under cold-starting conditions and given a 6-volt voltage. Under the same conditions, a flow rate of 120 liters per hour is obtained at 12 volts. As a consequence of the high pressure requirements, the motor has to be designed for the cold-starting point. At normal voltage, it is then over-dimensioned and must be operated cyclically to match the required operating point.

Figure 2:
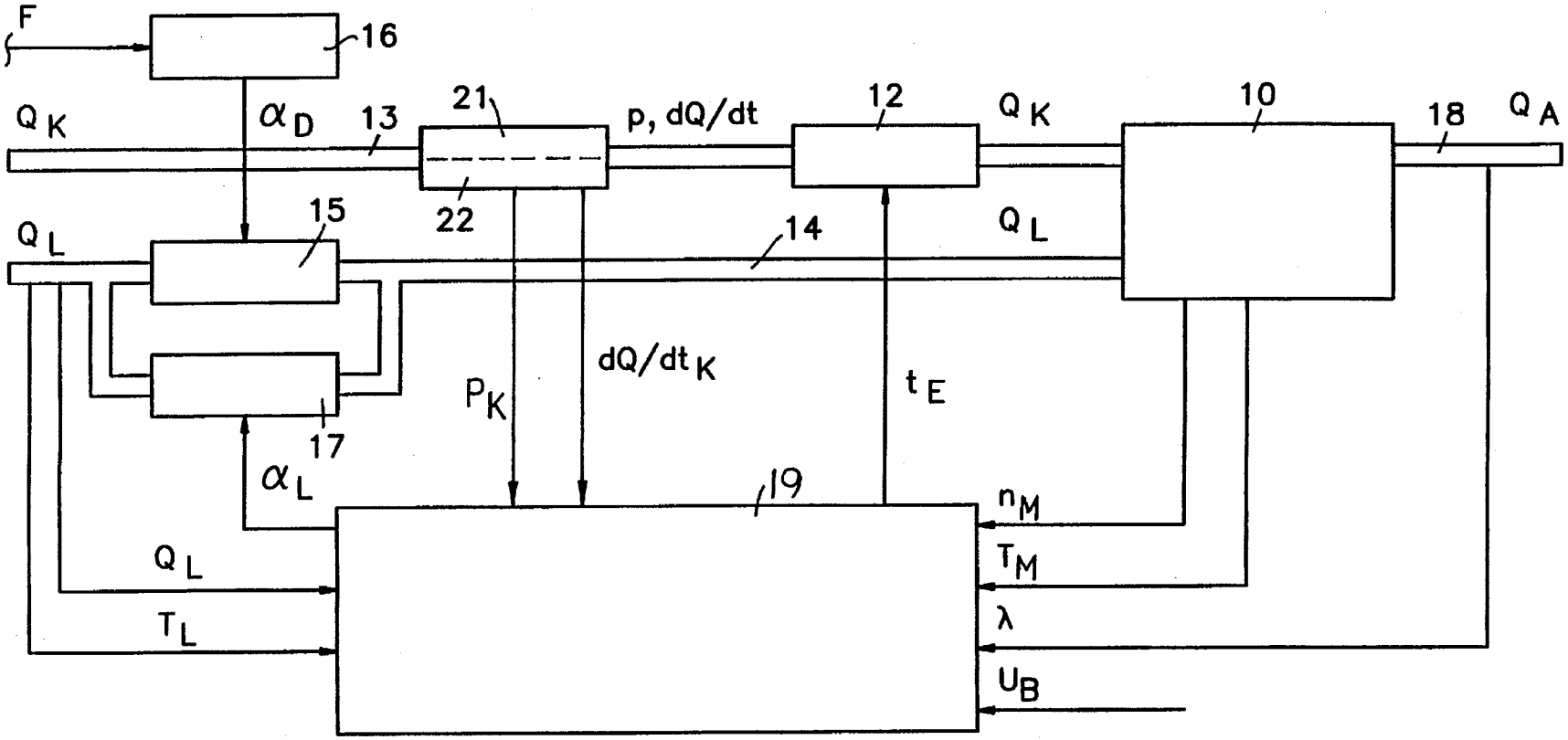
FIG. 2 shows a block diagram of the system according to the present invention with an observer-fitted electric fuel pump.

FIG. 2 shows a block diagram of the closed-loop engine control system with an observer-fitted electric fuel pump as an exemplary embodiment of the present invention. This system differs from the system shown in FIG. 1 in that the electric fuel pump 11 and the pressure regulator 20, where present, are replaced by an electric fuel pump with an observer 21. In comparison with the previous system, the electric fuel pump with an observer supplies the control unit 19 with additional information on the fuel pressure $P_K$ and the quantity of fuel per unit time $dQ/dt_K$. This is illustrated by the connections between the electric fuel pump with the observer 21 and the control unit 19. The remaining parts are the same as those in FIG. 1 and are also provided with the same designations.

In the system shown in FIG. 2, the fuel parameters of pressure p and flow rate $Q_K$ are recorded continuously in the observer electronics. These observer electronics 22 here form part of the block 21, for example, i.e. of the electric fuel pump with an observer.

By virtue of the continuous transfer of the recorded values to the control unit, the latter is able, particularly in the case of cold starting, to compensate for a lower fuel pressure via longer injection time. A simpler design of the fuel supply system is thus possible since the delivery rate of the fuel pump does not have to be designed for the cold-starting point at a low voltage of, for example, 6 volts.

Figure 3A:
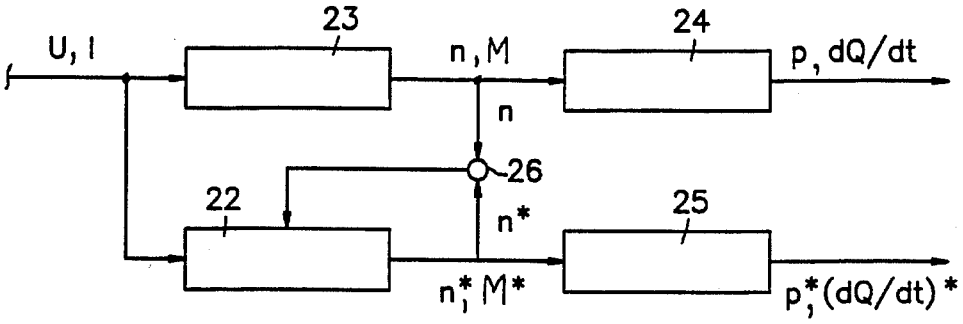
FIGS. 3*a* and 3*b* show the principle of observation without a pressure sensor.
Figure 3B:
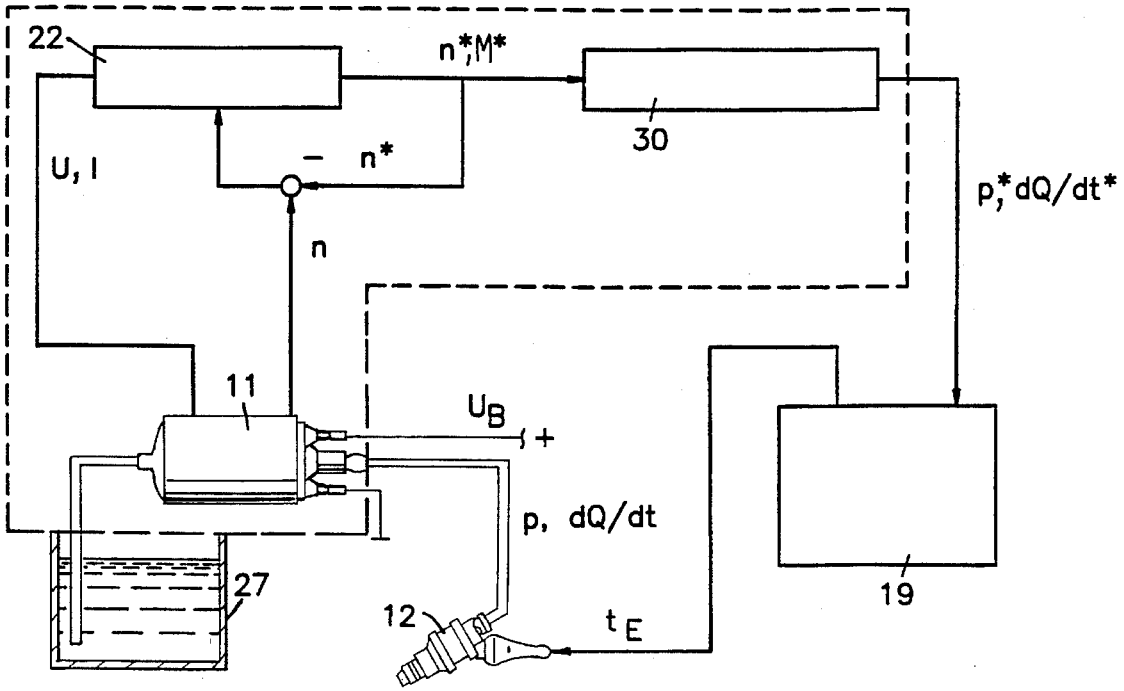

FIGS. 3*a* and 3*b* show a first principle for pressure and flow-rate observation in the fuel system. FIG. 3*a* illustrates how the values determined by calculation by the observer are obtained. FIG. 3*b* shows the linking between the pressure and flow-rate observation and the control unit of the internal combustion engine.

In FIG. 3*a*, 23 denotes the electronically commutated motor which drives the pump. The pump itself bears the reference numeral 24. As in FIG. 2, 22 denotes the observer and 25 denotes a pump model. Finally, 26 denotes a superimposition point at which pump speeds of rotation are compared.

The observer 22, which is integrated into the driving electronics, determines the respective operating point of the motor by measuring the terminal voltage U and the current I of the electric fuel pump and calculates the instantaneous values for the speed of rotation n of the electric fuel pump and the torque M. This calculation is performed using the corresponding motor equations or motor characteristics. The fuel flow delivered by the pump is dQ/dt and the fuel pressure is denoted by p.

Any temperature compensation which is necessary is carried out by incorporating previously determined temperature variations, which are stored, for example, in characteristic maps of the observer electronics.

If a signal n proportional to the speed of rotation is available in addition to the terminal voltage U and to the motor current I, this being achieved, for example, in the case of an electronically commutated motor by measurement with Hall sensors or by measurement of the induced voltage in the strand in which there is no current, the observer electronics can carry out the temperature compensation directly. The values determined by computation by the observer 22 are denoted in the description which follows and in the figures by a star, while the real values of the fuel system are without a star.

The calculated motor operating point (M*, n*) is compared with the stored pump characteristic map to determine the instantaneous fuel pressure and the instantaneous fuel flow rate. In order to compensate for any tolerances in the characteristic map of the pump, a feedback circuit between the observer 22 and the engine electronics is possible, and this is illustrated in FIG. 3*b*.

By means of this feedback circuit, the engine electronics, i.e. the control unit 19, can inform the observer 22 of deviations, allowing the observer electronics to correct the pump characteristic map in a learning manner. In this way, it is also possible to take account of wear which arises in the pump.

The arrangement described can determine the values for the fuel pressure and the fuel flow rate without direct pressure measurement by means of a pressure sensor and without direct measurement of the flow rate. The relationships according to which the control unit and the observer interact are represented in FIG. 3*b*.

In FIG. 3*b*, it can be seen that the values M*, n* determined by computation by the observer act on the pump characteristic map 30. This then supplies the values p*, (dQ/dt), likewise determined by computation, to the control unit 19, which can influence the injection time $t_E$ as a function of these values. The pressure p prevailing at the injection valves 12 and the time change of the flow rate dQ/dt give the quantity of fuel actually injected. The system illustrated in FIG. 3*b* otherwise manages without a return between the injection valves and the tank 27 from which the fuel is pumped.

Figure 4:
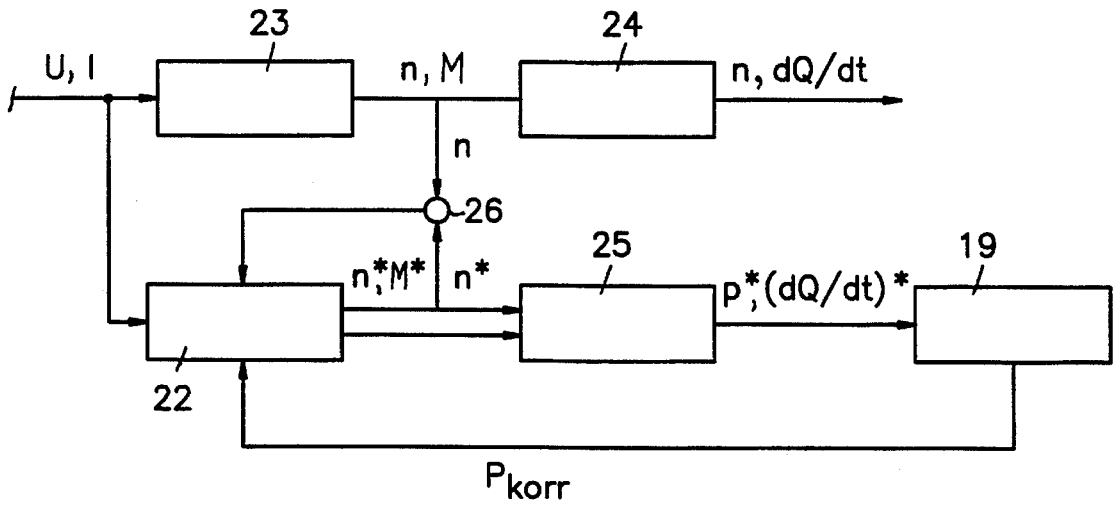
FIG. 4 shows the principle of observation with a pressure sensor and correction of the pump characteristic.

A further exemplary embodiment of the present invention is illustrated in FIG. 4. Here, there is a pressure sensor integrated into the driving electronics of the pump. The current fuel pressure is thus measured directly. The pressure across the injection valves is determined with the aid of the observer concept, taking into account the parameters of the fuel line.

In the exemplary embodiment shown in FIG. 4, there is no pressure regulator. The fuel return has likewise been dispensed with (because there is no excess fuel). Here, the fuel pressure across the injection valves 12 and the fuel flow rate are regulated directly by the observer. This is accomplished, for example, by the observer regulating the motor current I and thus holding the pressure p constant.

If the observer observes, for example, that the pressure rises during idling or in the case of overrun cut-off because little or no fuel is being injected, it can reduce the power of the pump motor. If, however, the pressure decreases, the observer assumes that fuel is being injected again. It then increases the power of the motor. In FIG. 4, this is illustrated by the additional variable $p_{korr}$. Accordingly, from the observer, a correction K is likewise fed to the pump model.

In the system illustrated in FIG. 4, the observer thus regulates the quantity of fuel delivered in accordance with the respective requirement. The elimination of the return leads to a reduction in the heating of fuel in the tank and hence to a reduction in tank emissions.

Figure 5:
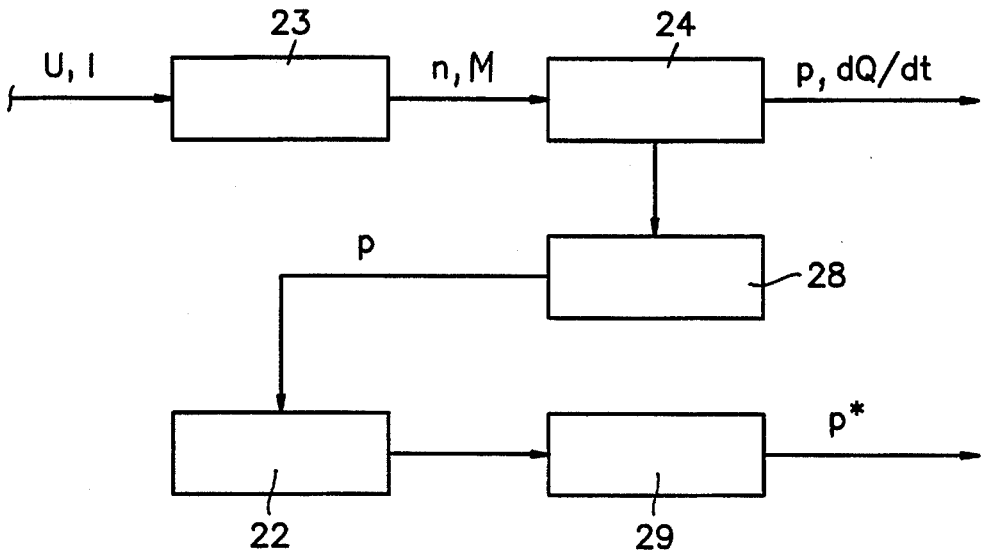
FIG. 5 shows a further principle of observation with a pressure sensor.

Finally, a further variant is illustrated in FIG. 5. In this exemplary embodiment, there is the possibility of forming a feedback loop between the observer and the engine electronics. In this feedback loop, the engine electronics supply the observer 22 with data which allow it to correct its pump characteristic map. The observer here learns its pump characteristic and is thus in a position to correct manufacturing tolerances and ageing phenomena.

In addition to the electrically commutated motor 23, the pump 24 and the observer 22, the exemplary embodiment shown in FIG. 5 also has a pressure sensor 28, which supplies the observer 22 with the measured pressure p, and a model of the fuel line 29 (computational model) by means of which the pressure p* determined by computation is obtained.

In the exemplary embodiment shown in FIG. 5, the engine electronics, i.e. the control unit 19, determines the injection time $t_E$ necessary for the injection quantity required from the fuel pressure p* supplied by the observer. If the expected values, those for lambda, for example, in the case of lambda closed-loop control of the engine, are not achieved within an injection time interval reasonable for this operating point, the control unit assumes that the fuel pressure indicated by the observer 22 is false, for example too small. There then follows an exchange between the control unit and the observer 22 involving communication to the observer 22 that its pump characteristic map should be corrected in a suitable manner.

In all exemplary embodiments, the elimination of the high cold-starting requirements which are necessary in conventional systems opens up the possibility of reducing the motor current of the electric fuel pump motor while keeping its overall volume the same and hence the possibility of reducing the temperature loading of the driving electronics.

Figure 6:
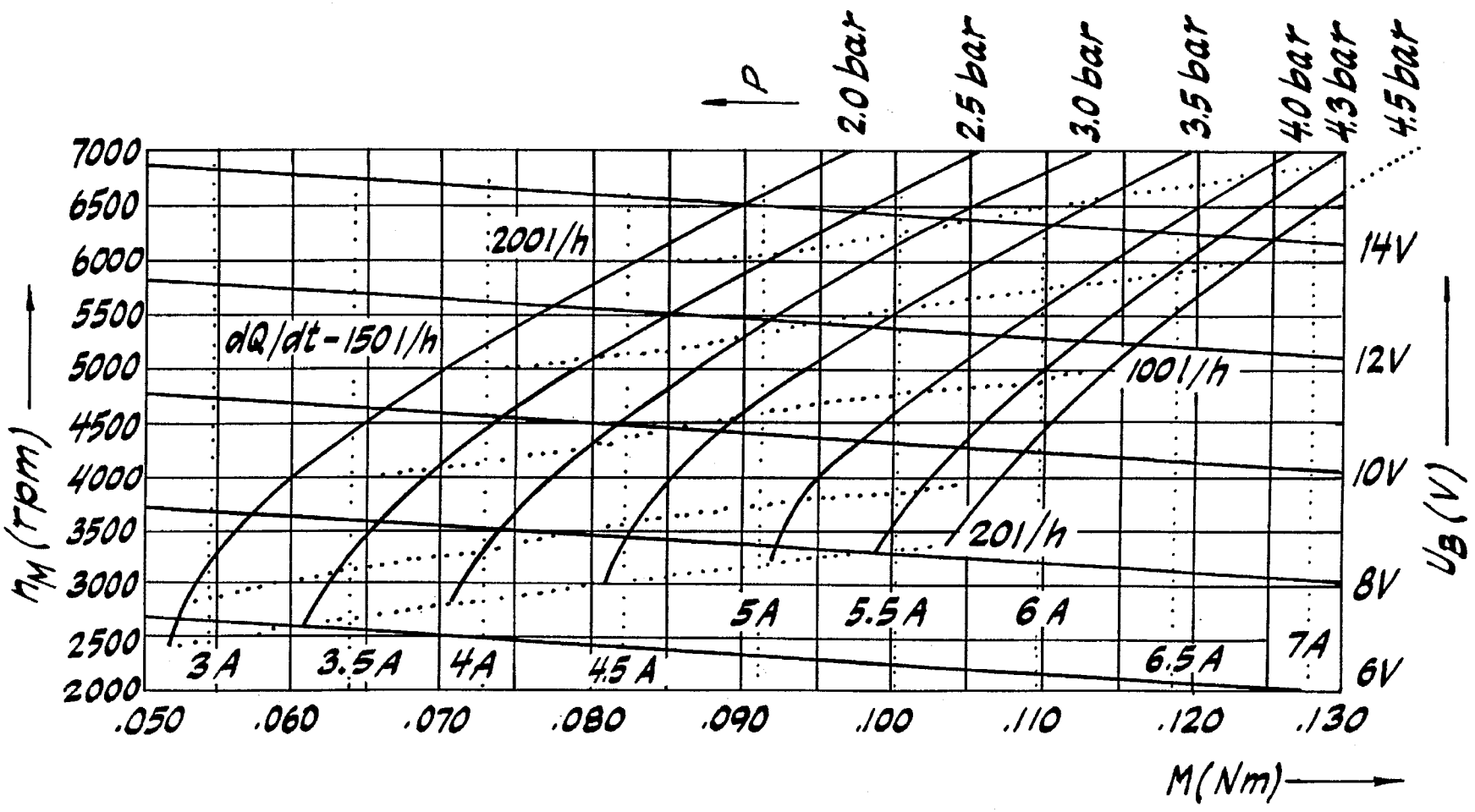
FIG. 6 shows the characteristic map of an electrically commutated fuel pump motor.

FIG. 6 shows motor and pump characteristics which illustrate the problems of regulating the pump. The parameters plotted are, in particular, the motor speed nM in rpm against the torque M in newton-meters. Also plotted are the battery voltage $U_B$ in volts and, in dotted lines, various current intensities (in amperes) and various flow rates dQ/dt in liters per hour (l/h). Various pressures p (in bar) are also indicated.

What is claimed is:

1. A fuel supply system for an internal combustion engine having at least one injection valve, the fuel system comprising:

an electric fuel pump for providing a flow of fuel, the electric fuel pump having a voltage, a current, a speed of rotation, and a torque; and an electronic system for determining a pressure of the fuel and a rate of the fuel flow as a function of at least one of the voltage, current, speed of rotation, and torque of the electric fuel pump to control the at least one injection valve.

2. The system according to claim 1, wherein the electronic system includes an observer.

3. The system according to claim 2, further comprising a control unit coupled to the electronic system for controlling a fuel injection time as a function of at least the determined fuel pressure and the determined fuel flow rate.

4. The system according to claim 3, wherein the observer utilizes a pump model, and the control unit forms a pressure correction value and transmits the pressure correction value to the observer.

5. The system according to claim 2, further comprising a pressure sensor for measuring the fuel pressure, the observer influencing a pressure at each of a plurality of injection valves as a function of the measured fuel pressure.

6. The system according to claim 5, wherein the pressure is influenced via a fuel line model.

7. The system according to claim 3, wherein the control unit controls a quantity of fuel in accordance with a predetermined requirement.

8. The system according to claim 3, wherein an output of the fuel pump is not matched to a cold-starting requirement, and the fuel pressure is increased when a cold start is detected.

9. A fuel supply system for an internal combustion engine having at least one injection valve, the fuel system comprising:

an uncontrolled electric fuel pump for providing a flow of fuel; and an electronic system for determining a pressure of the fuel and a rate of the fuel flow as a function of a plurality of measured operating variables specific to at least one of the engine and the fuel pump, the electronic system controlling the at least one injection valve as a function of at least one of the pressure of the fuel and the rate of the fuel flow.

* * * * *